United States Patent [19]

Seymour

[11] Patent Number: 4,913,084

[45] Date of Patent: Apr. 3, 1990

[54] APPARATUS USEFUL IN DEVICES FOR CONTROLLING THE THICKNESS OF COATING APPLIED TO A SUBSTRATE

[76] Inventor: Ronald P. Seymour, 3503 N Euclid Ave., Bay City, Mich. 48706

[21] Appl. No.: 340,277

[22] Filed: Apr. 19, 1989

[51] Int. Cl.[4] ..... B05C 1/04

[52] U.S. Cl. ..... 118/123; 118/419

[58] Field of Search ..... 118/100, 123, 205, 419, 118/216, 407, 126

[56] References Cited

U.S. PATENT DOCUMENTS

| | | | |
|---|---|---|---|
| 3,113,890 | 12/1963 | Johnson et al. | 118/126 |
| 3,128,207 | 4/1964 | Schmitt | 118/126 |
| 3,229,662 | 1/1966 | Means | 118/126 |
| 3,255,038 | 6/1966 | Coghill | 118/126 |
| 3,450,098 | 6/1969 | Williams | 118/126 |
| 3,722,465 | 3/1973 | Krautzberger | 118/123 |
| 3,882,817 | 5/1975 | Zink | 118/126 |
| 4,732,776 | 3/1988 | Boissevain | 118/407 |
| 4,774,107 | 9/1988 | Kwiatkowski et al. | 118/216 |
| 4,839,201 | 6/1989 | Ratanen et al. | 118/419 |

*Primary Examiner*—Willard Hoag
*Attorney, Agent, or Firm*—Robert L. McKellar

[57] ABSTRACT

What is disclosed is a coating machine for paper and like materials wherein the coating machine has as its novel feature a pneumatically controlled knife blade assembly which allows for the coating of thin, uniform coatings.

10 Claims, 5 Drawing Sheets

APPARATUS USEFUL IN DEVICES FOR CONTROLLING THE THICKNESS OF COATING APPLIED TO A SUBSTRATE

This invention deals with an apparatus useful in devices for controlling the thickness of coatings applied to a substrate such as coating on paper or other materials.

FIELD OF THE INVENTION

This invention relates to an apparatus useful in coating machines, primarily the type of machines that are used in paper coating. This apparatus is knife or blade that can be adapted to coating machines to enhance the ability of the operator to produce fine, uniform, thin coatings on various substrates.

Essentially, irrespective of the design of the overall coating machine, it is generally the knife part of the device that either allows acceptable or unacceptable films to be produced.

In the production of thick films, such as from foams or gells, or high viscosity coatings, the knife is not as critical, as thick materials can have a fair tolerance in their thicknesses for the types of applications that the coated substrates are used in.

On the other hand, the requirement of thin coatings creates special problems and requires special equipment to achieve. Especially important in those cases where flexible blades are part of the knife apparatus, is the angular relationship of the working edge of the knife blade to the substrate to be coated. Those skilled in the art attempt to have the working edge of the blade come in contact with the substrate to be coated without abrading the substrate. The obvious reason, of course, is to obtain the thinnest coating possible. However, generally, when this is attempted, the blade, or parts of it touch the substrate with varying amounts of pressure, and if the substrate is paper, the result is generally an abrasion of the paper, or at the worst, a tearing or shredding of the paper. The ultimate in this relationship of the blade edge to the substrate is that the blade uniformly "kisses" the substrate, that is, it touches the substrate uniformly across the working edge of the blade but none of the working edge of the blade touches the substrate with enough pressure to abrade, tear, or shred the substrate. The result of "kissing" the substrate is a fine, uniform, thin, or ultrathin coating.

Attempts have been made with prior devices to accomplish fine, uniform, thin, or ultrathin coatings, including mechanical operation of the knife blade using cams and pistons to build some precision into the movement of the knife blade to the substrate.

One such apparatus is disclosed by Schmitt in U.S. Pat. No. 3,128,207, issued on Apr. 7. 1964, in which he describes a complicated array of cams, cylinders and pistons, pivotal arms, and the like to move the doctor blade to the substrate which has been mounted on a drum. In this apparatus, the approach of the blade to the substrate and the removal of the blade away from the substrate requires a series of mechanical operations which are powered by air pressure, wherein the patentee indicates that the blade is sensitively operated thereby.

Although not the focal point of the invention, a similar device is shown in von Kwiatkowski et al., in U.S. Pat. No. 4,774,107, issued Sept. 27, 1988. In these types of devices, there is a certain amount of precision lost due to the clumsy operation and mechanical wear of the various mechanical devices utilized therein. Furthermore, these types of devices require constant adjustment and maintenance.

In U.S. Pat. No. 3,113,890, to Johnson et al, issued Dec. 10, 1963, there is disclosed an apparatus for smoothing coating materials on a paper web, which deals with a mechanical apparatus for clamping and bending a flexible steel blade to achieve a useful angle of the blade to form coatings. The device of Johnson et al deals essentially with the cylinders and pistons, cams, and pivotal arms, as is illustrated by the figures, however, in FIG. 6, with an explanation at column 4, beginning at line 39, there is shown a pressure bar 68 which has a trailing edge 70 and a pressure extremity 72, and which has a fulcrum point at 69 wherein the use of an air inflated bladder to raise the trailing edge of the pressure bar 68 to depress the extremity 72 onto the blade to cause the blade to bend and create the application of a thin coating. This device, because of its mechanical makeup, suffers from the same problems as the devices indicated above.

Finally, note should be made of U.S. Pat. No. 4,732,776, which issued on Mar. 22, 1988, to Boissevain. This patent deals with an apparatus and method for controlling the thickness of coatings on paper or other materials by using bimetallic, heat sensitive tongues intermittantly along the long axis of the knife blade to control the precise movement of the blade in a coating operation.

This patent also deals with the computerized control of the knife blade to give optimum control over the thickness of the coatings.

A cursory glance at the figures of this patent and a casual reading of this patent would lead one to believe that it only deals with the device as described above, however, upon a closer reading, and with reference to FIGS. 5 and 6, and with further reference to the specification at column 9, beginning at line 47 through column 10, line 53, it can be observed that the patentee uses several adjusting screw assemblies in conjunction with a pneumatic actuator assembly to control the thickness of the coatings applied by that device. The adjusting screw assemblies are first used to position a second assembly which is a holder, holding the flat tubular member a piston held in position by support posts, and a bar, which is the part that creates the thickness of the coating on the substrate. In spite of the fact that it is not specifically recited by the patentee, it can be assumed by those skilled in the art that the two small lips on the forward face of the tubular member not only interface with the piston, but also must be somehow attached to the piston in order to have the ability of the tubular member to withdraw the piston, and thereby the application bar 302. Secondly, it is indicated that this tubular member is designed to have individual chambers which are separately inflatable, which inflation controls the piston at the point of expansion of the inflatable chambers, which in turn controls the bar 302. The patentee further speculates at column 10, lines 51 to 53, that configurations of the invention using pneumatic pressure can be used with other metering elements, for example blades, but he does not indicate how this is accomplished or what devices need to be used, nor does he indicate the designs that are the most effective. In other words, the patentee urges that it be tried, but does not indicate how to do it. This is evidenced by the fact that all through the patent, the patentee deals with blades and devices used to manipulate them, but when he reverts to the use of the pneumatic system to accomplish the same end, he does not describe, show or discuss its use with flexible blades, he only describes, shows, and discusses its application with a piston and bar apparatus.

The applicant has spent a considerable amount of time determining how to simply use pneumatics, to directly control a thin, flexible blade to give thin, fine, uniform coatings without abrading, tearing, or shredding the substate.

Thus, the instant invention deals with a simple apparatus that when used with conventional coating devices gives thin, fine, uniform coatings without the concomittant problems associated with the use of mechanical configurations such as cylinders and pistons, cams, pivot arms and the like.

THE INVENTION

The apparatus of the instant invention overcomes the problems of the prior art machines and provides new and novel knife blade apparatus, and new and novel coating machines containing the novel knife blade apparatus, for overcoming such problems.

Specifically, the instant invention deals with the novel apparatus described herein which apparatus is useful in devices for controlling the thickness of coatings applied to a substrate, the apparatus comprising in combination a thin flexible blade having a lower working edge and an upper blunt edge and a front and a back planar surface a blade holder, a blade retainer detachedly fixed to the blade holder with the flexible blade slidably mounted therebetween, a pneumatically controlled blade adjuster situated in the lower portion of the blade holder and in direct contact with the back planar surface of the flexible blade but not attached thereto, a means to control said pneumatically controlled blade adjuster, a mechanical blade adjuster within said blade holder for adjusting the vertical height of the flexible blade relative to the blade holder, at least two vertical dams mounted on the blade holder, which dams directly contact the front planar surface of the flexible blade and which move in concert therewith and, means for rotatably mounting said apparatus in a coating machine.

More specifically, the instant apparatus comprises in combination, a thin flexible blade comprising a flat, generally rectangular shape, having a lower working edge and an upper blunt edge and a front planar surface and a back planar surface and having through it at least two, horizontal, generally rectangular shaped slots spaced away from the vertical center of the flexible blade, and having at least three, vertical, generally rectangular shaped slots equally spaced along the long axis of the flexible blade, a blade holder, said bladeholder comprising a housing which emulates the shape and the length of the flexible blade, said bladeholder containing therein at least two mechanical adjusting means and a pneumatically controlled adjusting means, each said mechanical adjusting means comprising a grooved roller pin having mateable threads on its outside surface on a portion of its upper half and having its groove located near its bottom end, said grooved roller pin passing slidably through holes in the top surface of the housing and near the ends of the housing, said roller pin further passing through a threaded opening in an adjusting block, said adjusting block moving up or down on the threaded portion of the threaded, grooved pin when the pin is turned in the hole through the top surface, each said adjusting block intersecting and passing through one of the horizontal slots in the flexible blade, said threaded grooved pin terminating in, and seating in, a receptacle cup provided in the interior of the housing and located at about the horizontal midline of the housing, said threaded, grooved pin being secured in the cup by a horizontally inserted pin passing through a hole in the back planar wall of the housing and intersecting the groove of the threaded, grooved pin, a blade retainer running the length of the flexible blade and detachedly fixed to the blade holder with the flexible blade slidably mounted therebetween, at least two vertical dams attached to the blade retainer on its outer surface such that they do not extend below the working edge of the flexible blade and such that they move in concert with any movement of the flexible blade, the lower ends of said dams conforming essentially to the configuration of the surface to be coated, the pneumatically controlled adjusting means being located in the bottom half of the housing and comprising a longitudinal slot running the length of the housing, having contained therein an air expandable singular tube running the full length of the longitudinal slot said air expandable tube being sealed at one end, the opposite end being open to an air inlet port, said air inlet port being connected to a regulated air source by a supply tube, said air expandable tubing interfacing directly with the flexible blade along its entire length, said applicator having means for being rotatably mounted on a coating machine.

There is further provided by this invention, a coating machine comprising in combination conventional elements of a coating machine and substituted for any applicator blade assembly therein, an inventive apparatus of this invention which is a thin flexible blade having a lower working edge and an upper blunt edge and a front and a back planar surface, a blade holder, a blade retainer detachely fixed to the blade holder with the flexible blade slidably mounted therebetween, a pneumatically controlled blade adjuster situated in the lower portion of the blade holder and in direct contact with the back planar surface of the flexible blade but not attached thereto, a means to control said pneumatically controlled blade adjuster, a mechanical blade adjuster within said blade holder for adjusting the vertical heighth of the flexible blade relative to the blade holder, at least two vertical dams mounted on the blade holder, which dams directly contact the front planar surface of the flexible blade and which move in concert therewith and, means for rotatably mounting said apparatus in the coating machine.

There is further provided by this invention, a coating machine comprising in combination conventional elements of a coating machine and substituted for any applicator blade assembly therein, an inventive apparatus of this invention comprising in combination, a thin flexible blade comprising a flat, generally rectangular shape, having a lower working edge and an upper blunt edge and a front planar surface and a back planar surface and having through it at least two, horizontal, generally rectangular shaped slots spaced away from the vertical center of the flexible blade, and having at least three, vertical, generally rectangular shape slots equally spaced along the long axis of the flexible blade, a blade holder, said bladeholder comprising a housing which emulates the shape and the length of the flexible blade, said bladeholder containing therein at least two mechanical adjusting means and a pneumatically controlled adjusting means, each said mechanical adjusting means comprising a grooved roller pin having mateable threads on its outside surface on a portion of its upper half and having its groove located near its bottom end, said grooved roller pin passing slidably through holes in the top surface of the housing and near the ends of the housing, said roller pin further passing through a threaded opening in an adjusting block, said adjusting block moving up or down on the threaded portion of the threaded, grooved pin when the pin is turned in the hole through the top surface, each said adjusting block intersecting and passing through one of the horizontal slots in the flexible blade, said threaded grooved pin terminating in, and seating in, a receptacle cup provided in the interior of the housing and located at about the horizontal midline of the housing, said threaded, grooved pin being secured in the cup by a horizontally inserted pin passing through a hole in the back planar wall of the housing and intersecting the groove of the threaded, grooved pin, a blade retainer running the length of the flexible blade and detachedly fixed to the blade holder with the flexible blade slidably mounted therebetween, at least two vertical dams attached to the blade retainer on its outer surface such that they do not extend below the working edge of the flexible blade and such that they move in concert with any movement of the flexible blade, the lower ends of said dams conforming essentially to the configuration of the surface to be coated, the pneumatically controlled adjusting means being located in the bottom half of the housing and comprising a longitudinal slot running the length of the housing, having contained therein an air expandable singular tube running the full length of the longitudinal slot, said air expandable tube being sealed at one end, the opposite end being open to an air inlet port, said air inlet port being connected to a regulated air source by a supply tube, said air expandable tubing interfacing directly with the flexible blade along its entire length, said applicator having means for being rotatably mounted on a coating machine.

One advantage of the instant invention is the simple use of pneumatic control of a knife blade in a coatin machine to control the thickness of any applied coating to give thin, fine, coatings across the substrate.

With the inventive knife blade of this invention, it is possible to give uniform coatings across the substrate because of the ability of the inventive apparatus to give fine openings between the substrate to be coated and the working edge of the knife blade without abrading, tearing or shredding the substrate, all of which is accomplished with a simple apparatus, not requiring cylinders and pistons, cams, pivotal arms and the like.

BRIEF DESCRIFTION OF THE DRAWINGS

This invention will be described with reference to the accompaning drawings, which are illustrative of the embodiments of the invention falling within the scope of the appended claims, and in which:

DESCRIPTION OF THE PREFERRED EMBODIMENTS OF THE INVENTION

Figure 1:
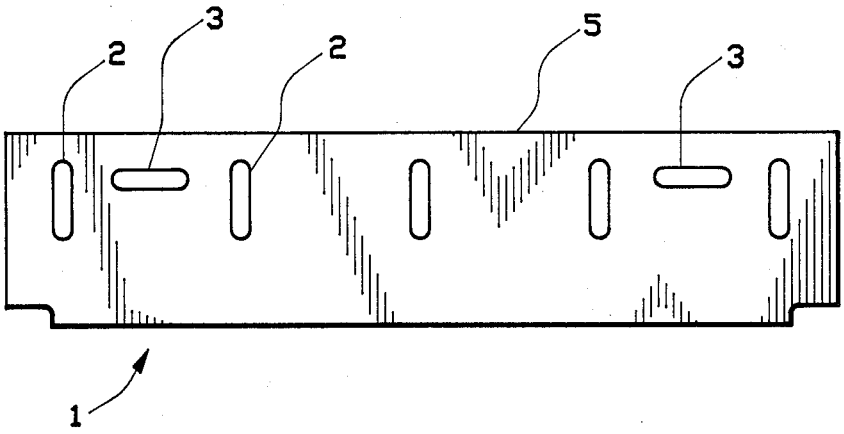
FIG. 1 is a full front view of the blade used in the inventive apparatus.

Referring now to FIG. 1 where there is shown a full front view of a blade 1 which forms part of this invention and in which there is shown a thin, flat, essentially rectangular shaped plate having several slots cut through it. This blade 1 must be flexible with regard to movement out of its vertical plane as will be evident in the disclosure set forth below. This blade can be manufactured from flexible metal or plastic, a preferred metal being spring steel and a preferred plastic being hard polyurethane, the most preferred metal being spring steel, the choicest spring steel being blue spring steel. Generally, the thickness of this blade does not exceed about 0,050 inches and can be as thin as 0.015 inches, with the preferred thickness being about 0.025 inches (24 gauge). In the blade 1 are cut several slots. With reference to the vertical slots 2, it can be observed that these slots, for purposes of this invention should be spaced essentially equally apart and are located nearer to the top of the blade than they are to the bottom of the blade. It can be further observed that there is shown five such slots 2 which is the preferred number of slots for this invention, but the invention only requires that there be at leas two such slots, the decision being based on the degree of stability that the manufacturer desires in the blade 1 after it is fastened in place. These slots 2 are shown as shaped elongated ovals, but can for all purposes, be rectangular or square shaped slots. These slots 2, are used to guide the blade 1 as it is mechanically adjusted up and down on a blade holder 6 (to be described infra). The horizontal slots 3 situated in the blade are designed to accommodate an adjusting block 29, which will be described below, it being noted that the adjusting block 29 has a configuration which allows allows it to project through the horizontal slots 3 and allows the mechanical adjustment of the blade 1 in a vertical motion. As with the slots 2, the slots 3 are shown as elongated ovals, but can for purposes of this invention be rectangular or square in shape. The blade 1 as shown has a working edge 4 and a blunt edge 5, the blunt edge 5 being the upper edge of the blade 1 the working edge 4 being the lower edge of the blade 1 and the edge which touches the coating material when in use. Generally, the working edge needs to be fashioned to accomodate the type of coating that is being applied to the substrate. The blade 1, being thin, and tilted out of the horizontal plane when in use provides the appropriate edge for most coating. However, the leading edge of the blade 1 (the edge touching the substrate) can be cut and honed to provide a rounded edge, the radius of such a rounded edge being on the order of about 0.002 to 0.010 inches, the intention being that the sharper the edge, the better that the blade will accomodate the more viscous coatings, while the more rounded the edge the less viscous the coatings, to provide the best coatings.

Figure 2:
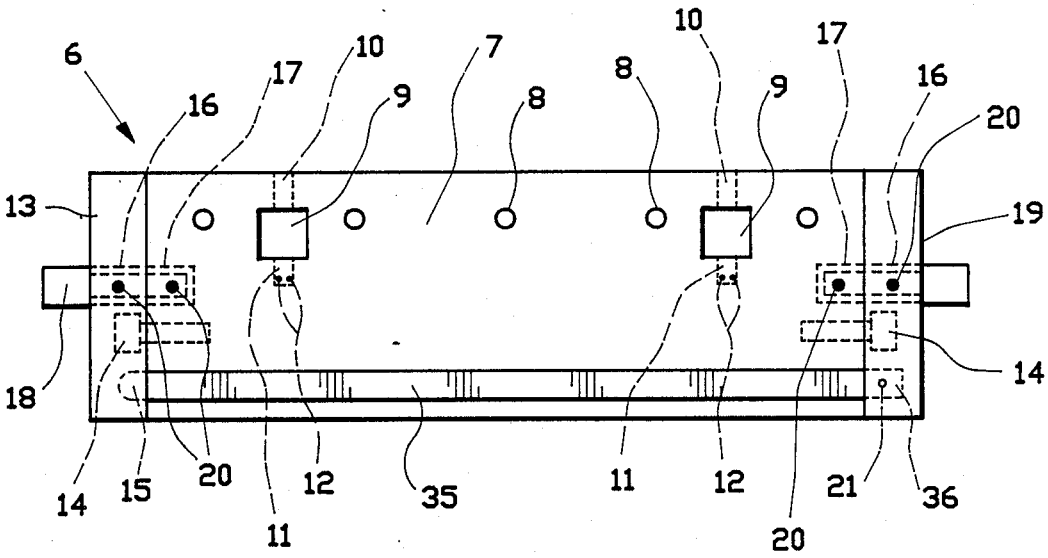
FIG. 2 is a full front view of the blade holder of the inventive apparatus, showing some of the elements in phantom.

With reference to FIG. 2, there is shown a blade holder 6 in full plan view, which is essentially a housing, with certain of the elements shown in phantom. The blade holder 6 is generally manufactured from a metal or hard plastic, with metal being the preferred material, and with aluminum being the most preferred material owing to its light weight and ease of workability. There is shown in the face 7 of the blade holder 6, several countersunk and tapped or threaded holes 8 which are used to accomodate threaded machine screws when the apparatus of this invention is finally assembled. Again, the number of threaded holes 8 depends on the number of support points that one wishes to use to hold the assembly together. As indicated supra, with reference to the blade 1, there is shown five such holes 8, which is the preferred number for this invention, but the invention requires only a minimum of two such holes 8.

Also in the face 7 there is shown two square holes 9 which are cut into the blade holder 6 to accomodate the movement up and down of the adjustment blocks 29 described below. Thus, the square holes 9 should be wide enough and deep enough to accomodate the adjusting block and also must be high enough to allow the movement of the adjusting block 29 up and down through any desired height adjustment. As shown in the FIG. 2, the holes 9 are cut all the way through the housing of the blade holder 6, but they could also be square slots which are cut and countersunk into the housing.

At the top of the blade holder 6, and directly down through each of the square holes 9, there is shown in phantom drilled holes 10. It should be noted that the holes 10 continue down beyond the square holes 9 and into the housing where they terminate in cups at points 11. The holes 10 are used to accomodate grooved pins 30 (shown in FIG. 4), which pass through the top of the housing via the holes 10 and are threaded through adjusting blocks 29 situated in the square hole 9 and then pass on into the cups at points 11 where they are seated. Also at points 11, there are shown small holes 12, in phantom, which are small, horizontal holes that have been drilled into the blade holder 6 from the back of the housing. These small holes 12 are used to insert small pins (not shown) which intercept the groove 31 of grooved pin 30, to lock the grooved pins 30 into the housing.

Taking into consideration the left end of the blade holder 6, there is shown a cap 13, which has essentially the same overall dimensions of the blade holder 6 and which is securely fastened to the blade holder 6 by a countersunk machine screw 14, shown in phantom. Also, there is shown in phantom at the bottom of the cap 13 an internal countersink 15, which will be described in detail infra with regard to the pneumatic control. Further, there is shown in phantom, holes 16, which are drilled through the cap 13 and the cap 19, and which are aligned to match countersinks 17 in the housing. These holes 16 and the countersinks 17 accomodate axial shafts 18 which are used to support the assembly and allow the assembly to be rotated during use. The axial shafts are securely held in place through the use of pins or threaded machine screws 20.

With reference to the right hand end of the blade holder 6, the cap 19 is quite similar to the cap 13, however, it should be noted that in the back of the countersink 36, there is shown in phantom a small port 21, which port allows the passage of air into the countersink 36, the significance of which will be set forth below regarding the pneumatic control of the assembly.

Figure 3:
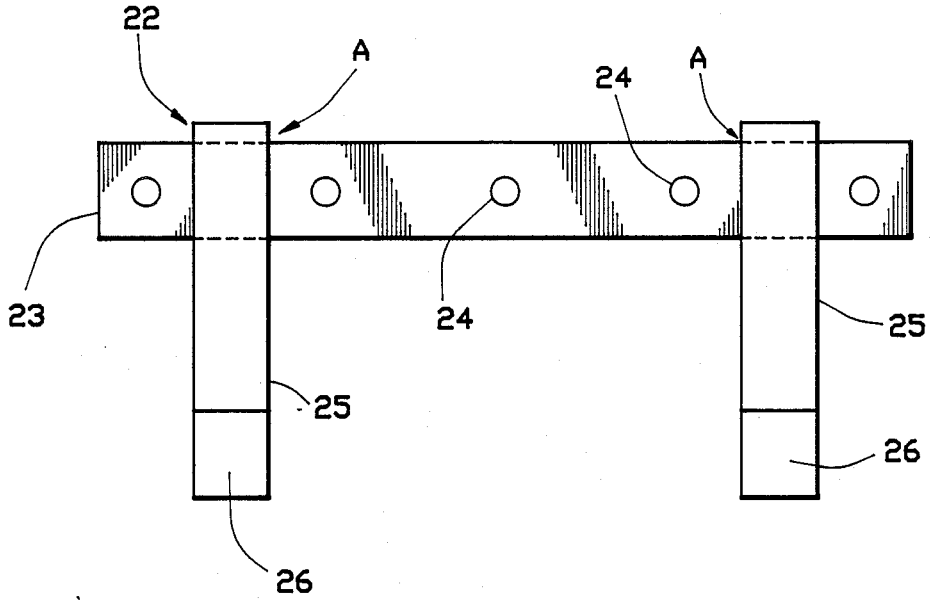
FIG. 3 is a full front view of the blade retainer of the inventive apparatus.

FIG. 3 shows a full plan view of the blade retainer 22 of this invention wherein there is shown a metal or plastic bar 23 which has an overall length essentially equivalent to the length of the blade holder 6 as illustrated in FIG. 2 and which is significantly narrower from top to bottom than the blade holder 6. The significance of the narrowness of the bar 23 resides in the fact that the blade retainer 22 must not only be strong enough to retain the blade 1 in place on the blade holder 6, but it also must not interfere with the displacement of the blade 1 during the operation of the assembly. Thus, the bar 23 when in use, should be narrow and should be mounted towards the top of the blade holder 6 in order to allow the movement of the working edge 4 out of the vertical plane. The mounting of the blade retainer 22 is accomplished by the use of several machine screws or set screws, which are inserted through the holes 24 of the bar 23, which holes are designed such that they are aligned with the tapped and threaded holes S of the blade holder 6 such that when the blade 1 is mounted on the blade holder 6 and the machine screws are inserted through the holes 24, and on through the slots 2 of the blade 1 and into and seated in the tapped and threaded holes 8 of the blade holder 6, the blade 1 is pressed and held between the blade holder 6 and the blade retainer 22.

Also shown in FIG. 3 are two dams 25, which prevent the lateral movement of any coating material that is being applied to a substrate. The dams 25 are held in place by a compression fit over the bar 23 and it should be obvious to those skilled in the art that there are notches cut into the dams 25 in order to accomodate the seating of the bar 23 in the dams 25 so as to present a flat surface to the blade 1 and, notches cut into the bar 23 at the points A in order for the blade retainer 22 to allow the passage of the adjusting block 29 in its movement while adjusting blade 1 during the final assembly of the apparatus. The notches can be observed in FIG. 5. The dams 25 are mounted so that they never extend beyond the working edge 4 of the blade 1 and in fact are mounted such that they fall slightly short of the working edge 4 of the blade 1 as can be observed by reference to FIG. 5. Further, since the apparatus of the instant invention is used mainly for the coating of materials which are presented to the working edge 4 of the blade 1 while mounted on a cylinder, the leading edge 26 of the dams 25 are beveled or conformed to the surface of the cylinder to provide a close fit as is possible. The dams are also moveable in a slidable motion along the long axis of the bar 23.

Figure 4:
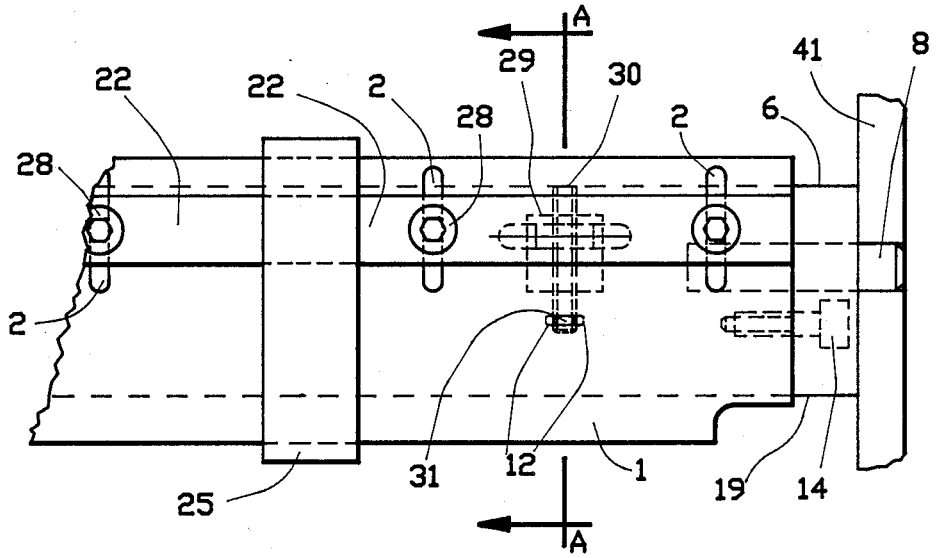
FIG. 4 is a partial view of the fully assembled apparatus of this invention essentially showing the right hand end thereof.

As indicated, FIG. 4 is a partial plan view of the completely assembled apparatus in order to show the alignment and placement of the component parts, most significantly, the mechanical adjusting mechanism that was described supra.

There is shown a support 41 which support is part of a coating machine and is shown here for purposes of identifying, in part, how the apparatus is mounted on a coating machine. Thus, there is shown axial shaft 8, dam 25, the blade 1, the blade holder 6, the blade retainer 22, machine screws with washer 28 which pass through the holes 24 of the blade retainer 22, through the elongated holes 2 of the blade 1, and on into the threaded holes 8 where they are drawn tightly and thereby clamp the assembly together. Also shown is the machine screw 14 which holds the cap lg in place. Further shown in phantom, is the mechanical adjusting means which comprises one of the adjusting blocks 29 and one of the grooved pins 30, showing the groove 31 located near to the bottom end of the grooved pin 30. Also shown in FIG. 4 are the two pins 32 which are inserted from the back side of the assembly and which intercept the groove 31 of the grooved pin 30 and which locks the pin in place while allowing it to turn in the hole 10. The configuration of the mechanical adjusting means will become evident by a discussion of FIG. 5.

Figure 5:
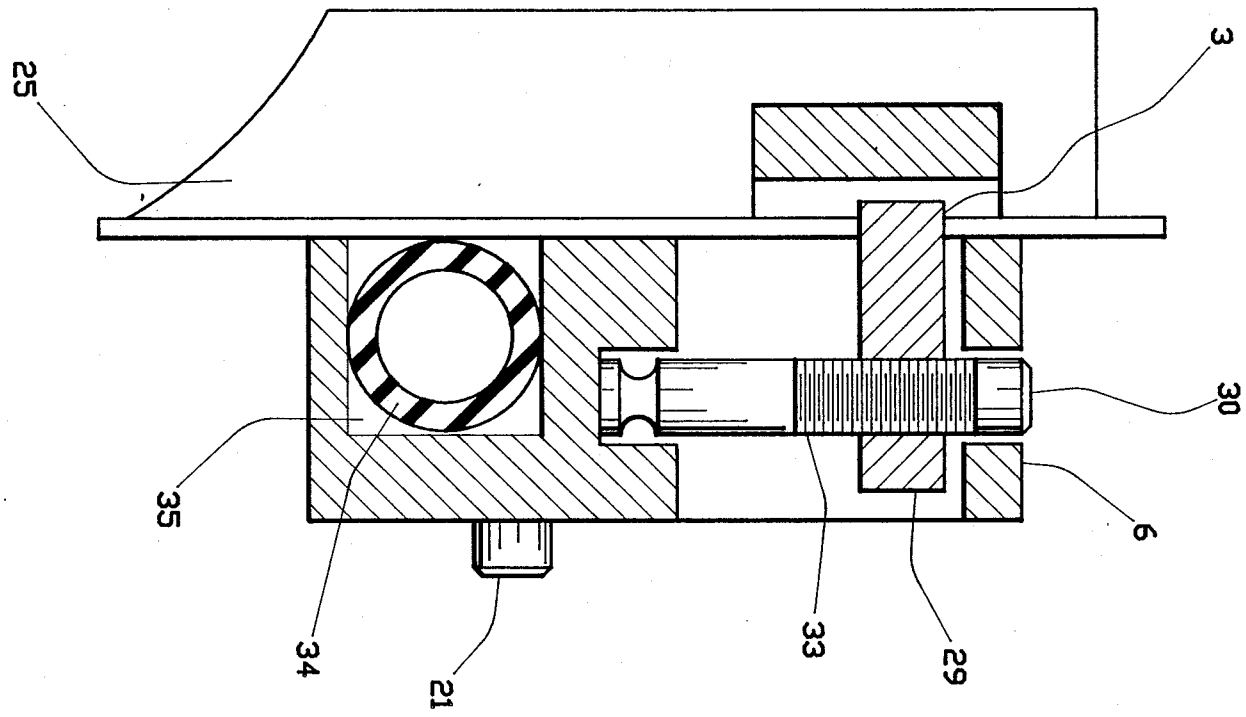
FIG. 5 is a sectional view of the assembled apparatus of this invention through the line A—A of FIG. 4.

FIG. 5 shows a dam 25 mounted on bar 23, the dams in combination with the bar 23 constitute the blade retainer 22 of the instant invention. There is also shown the blade holder 6 further showing in its interior an adjusting block 29 with a threaded hole 32 therethrough, set just slightly off center of the block in order to allow the adjusting block 29 to protrude through the horizontal slot 3 in the blade 1. There is also shown threads 33 on the upper middle portion of the adjusting block 29, which threads mate with those of the threaded hole 32 such that by twisting the grooved pin 30, the adjusting block 29 rides up and down on the grooved pin 30 and thereby causes the blade 1 to move up and down in adjustment as it lays between the blade holder 6 and the blade retainer 22. If should be obvious to those skilled in the art that the machine screws 28 must be loosened in order to move the blade 1 into adjustment and then retightened to hold the blade 1 in place. Typically, this adjustment is accomplished by mounting the apparatus on the coating machine, rotating the blade down to the substrate to be coated, and adjusting the mechanical adjustments to about 0.015 inches of gap between the substrate to be coated and the working tip 4 of the blade 1. The final adjustments in this gap occur with the use of the novel feature of this invention, the pneumatic controlled adjustment.

The pneumatic controlled adjustment comprises the use of an air expandable singular tube 34 running the full length of a longitudinal slot 35 (see also FIG. 2), said air expandable tube 34 being sealed at one end in the countersink 15 such that it is air tight, the opposite end being open to an air inlet port 21 which connects with the open end of the air expandable singular tube 34 by a small chamber formed by the blunt end of the tube 34 and the countersink 36 (see FIG. 1). The inlet port 21 is further connected to an air supply tube 37 shown in FIG. 7 which in turn is connected to an air regulator 48 and a supply of compressed air. It is important, and it should be especially noted that the tube 34 contacts the back planar surface of the blade, near the working edge 4 of the blade 1 and during operation, the entire length of the tube 34 presses against the back planar surface of the blade 1 and near the working edge and pushes it gently away from the blade holder 6. By this means, the finest of adjustments of the pressure between the leading edge of the working edge 4 of the blade 1 and the surface of the substrate to be coated can be created. Further, because the blade 1 is pressed along its entire length by the tube 39, the pressure that is created is uniform. Further, there is no segmentation of the pressure applied to the working edge 4 of the blade 1 which means that further confidence in the uniformity of the coating can be had. It should be understood from the above, that the result is a coating that is extremely thin and uniform from side to side of the substrate, and that the machine utilizing the inventive apparatus of the instant invention can be counted on to give consistancy from run to run, because once it is determined just exactly what air pressure gives a certain pressure, the same pressure can be created again just by adjustment of the air pressure to the same level.

The inventive apparatus of the instant invention is useful on most conventional coating machines. It is useful in single roll machines and multiple roll machines whether the machines are manually operated or whether they are operated by electrical power or air power. One such coating machine is illustrated in FIGS. 6 and 7 wherein the apparatus of the instant invention is utilized.

Figure 6:
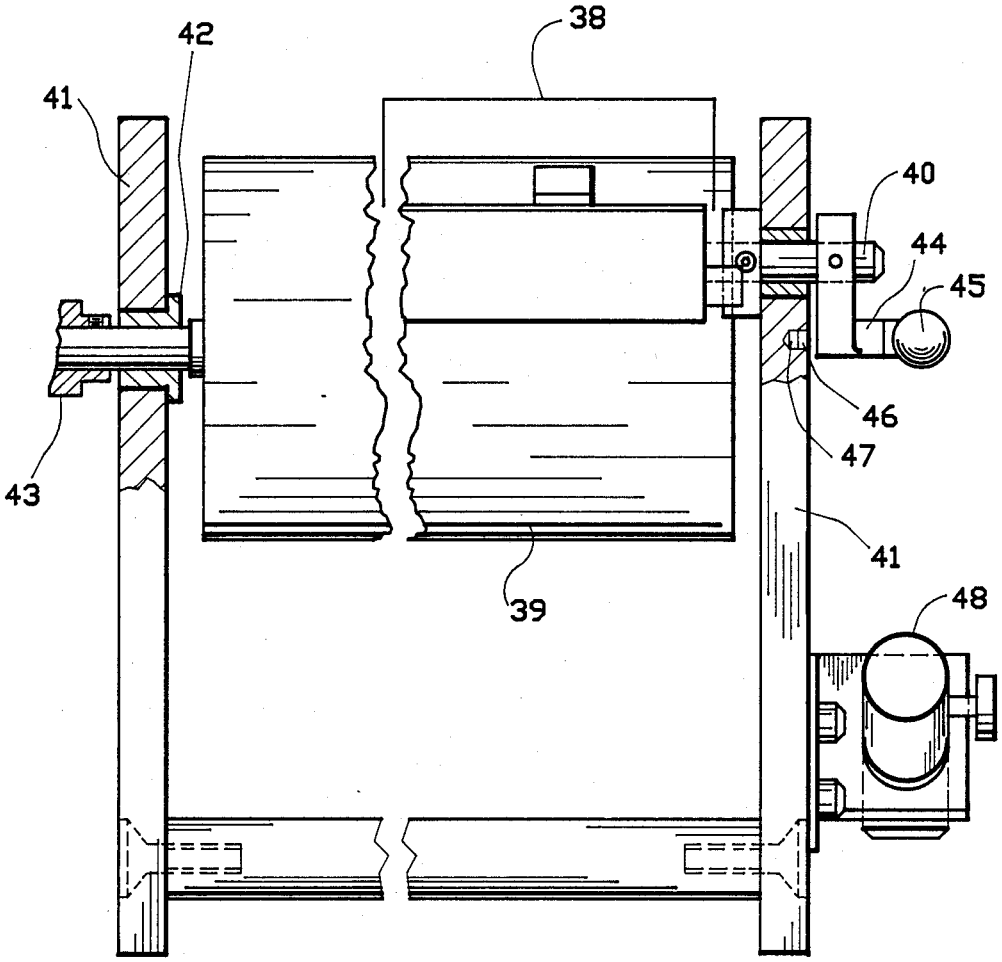
FIG. 6 is a full back view of one type of coating machine containing an apparatus of this invention.
Figure 7:
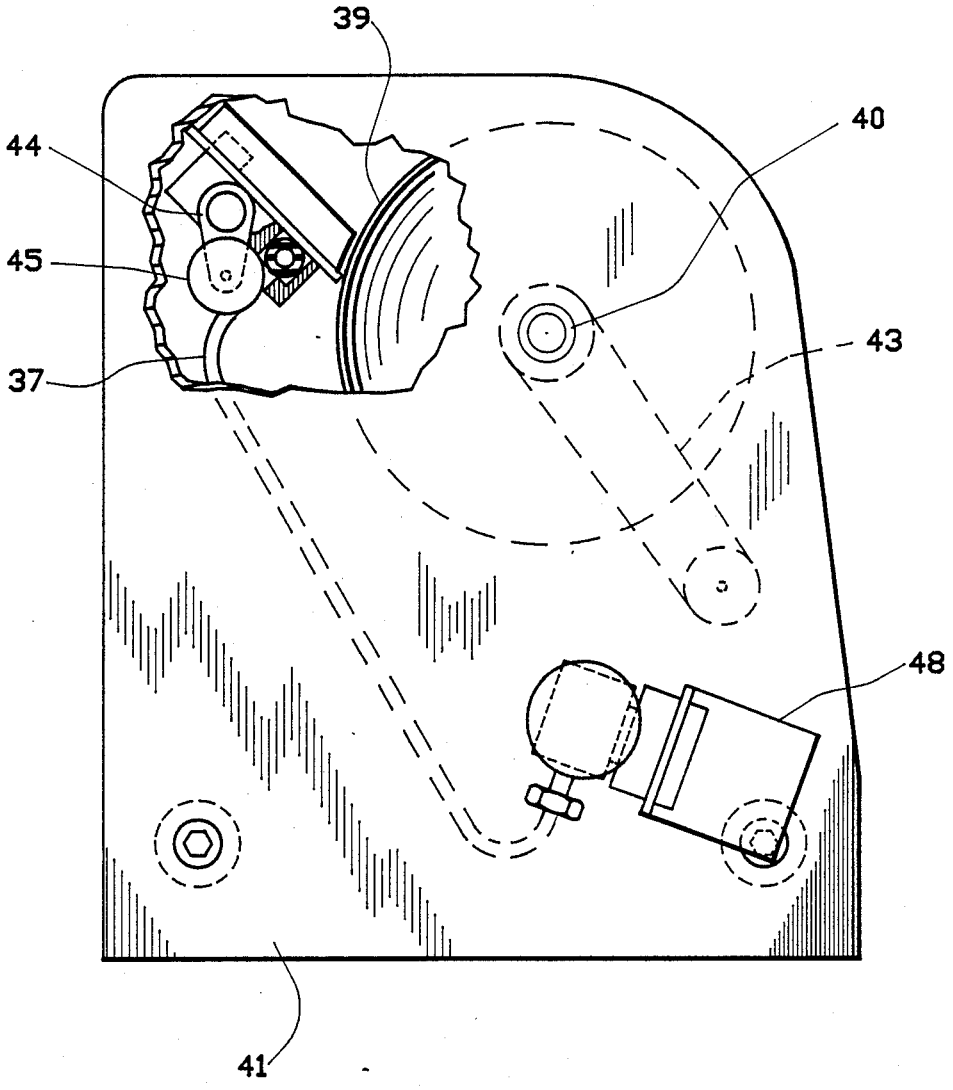
FIG. 7 is a side view of the machine of FIG. 6 from the right hand side of the machine.

FIGS. 6 and 7 should be considered when taking note of the following. These figures show a commercial single roll coating machine which has been equipped wit the inventive apparatus of the instant invention. In these figures, like numbers indicate equivalent elements. There is shown in FIG. 6, a back view of the machine with the apparatus 38 of the instant invention mounted on the machine along with a cylindrical roller 39 on which paper or other such material is to be coated, is mounted. The roller 39 is mounted on a central axle 40 and is supported on both ends by a two-sided stand 41 wherein the central axle 40 is fitted into bearings 42 at each end of the axle 40. On the left side of the stand 40, at the very end of the axle, there is detachedly fixed, a drive means 43 to rotate the roller 39. The drive means can be either manual or powered. On the right side of the machine, there is shown a crank handle 44, which is detachedly fixed to the very end of the axial shaft 18 which is part of the apparatus 38. At the point opposite of where the knob 45 of the crank handle 44 is attached, there is shown a metal peg 46, Which fits into a hole 47 drilled into the side of the support 41. As shown, this is the operating position of the crank handle 44 and of course, the apparatus of the instant invention, as well. The crank handle 44 is spring loaded and the spring draws towards the stand 41, such that in order to move the crank handle 44, the crank handle 44 has to be pulled perpendicular to the vertical face of the stand 41 to remove the metal peg 46 from its anchor in the hole 47. At this point the crank handle, and consequently the apparatus 38 can be moved in almost a 360° circle. When it is desired to anchor the apparatus 38, the crank handle 44 is returned to its original, operating position and the spring draws the crank handle 44 toward the face of the stand 41 and the metal peg 46 reinters the hole 47 and again anchors the apparatus 38. Also, with reference to FIG. 6, there is located on the lower right side of the support 41, an air regulator 48, which as can be observed from FIG. 7, is attached by a tube 37 to the inlet port 21 of the apparatus 38. The air regulator 48 in turn is attached to a compressed air supply which is not shown. FIG. 7 shows a side view of the machine and the installed apparatus 38. Thus, what has been described is a new and novel machine that is useful for the coating of various substrates, such as paper. In the actual production and use of the coating machines claimed herein, there has not been any knowm limitations as to the width of substrate that can be accomodated by the apparatus of the invention. Further, the machines of this invention have been extremely successful in full production runs to give commercial grade coated materials.

I claim:

1. An apparatus useful in devices for controlling the thickness of coatings applied to a substrate, the apparatus comprising in combination:

a thin flexible blade having a lower working edge and an upper blunt edge and a front and a back planar surface;

a blade holder;

a blade retainer detachedly fixed to the blade holder with the flexible blade slidably mounted therebetween;

a pneumatically controlled blade adjuster situated in the lower portion of the blade holder and in direct contact with the back planar surface of the flexible blade but not attached thereto;

a means to control said pneumatically controlled blade adjuster;

a mechanical blade adjuster within said blade holder for adjusting the vertical height of the flexible blade relative to the blade holder;

at least two vertical dams mounted on the blade holder, which dams directly contact the front planar surface of the flexible blade and which move in concert therewith and, means for rotatably mounting said apparatus in a coating device.

2. An apparatus useful in machines for controlling the thickness of coatings applied to a substrate, the apparatus comprising in combination:

a thin flexible blade comprising a flat, generally rectangular shape, having a lower working edge and an upper blunt edge and a front planar surface and a back planar surface and having through it at least two, horizontal, generally rectangular shaped slots spaced away from the vertical center of the flexible blade, and having at least three, vertical, generally rectangular shaped slots equally spaced along the long axis of the flexible blade;

a blade holder, said bladeholder comprising a housing which emulates the shape and the length of the flexible blade, said bladeholder containing therein at least two mechanical adjusting means and a pneumatically controlled adjusting means;

each said mechanical adjusting means comprising a grooved roller pin having mateable threads on its outside surface on a portion of its upper half and having its groove located near its bottom end, said grooved roller pin passing slidably through holes in the top surface of the housing and near the ends of the housing, said roller pin further passing through a threaded opening in an adjusting block, said adjusting block moving up or down on the threaded portion of the threaded, grooved pin when the pin is turned in the hold through the top surface, each said adjusting block intersecting and passing through one of the horizontal slots in the flexible blade, said threaded grooved pin terminating in, and seating in, a receptacle cup provided in the interior of the housing and located at about the horizontal midline of the housing, said threaded, grooved pin being secured in the cup by a horizontally inserted pin passing through a hole in the back planar wall of the housing and intersecting the groove of the threaded, grooved pin, a blade retainer running the length of the flexible blade and detachedly fixed to the blade holder with the flexible blade slidably mounted therebetween;

at least two vertical dams attached to the blade retainer on its outer surface such that they do not extend below the working edge of the flexible blade and such that they move in concert with any movement of the flexible blade, the lower ends of said dams conforming essentially to the configuration of the surface to be coated;

the pneumatically controlled adjusting means being located in the bottom half of the housing and comprising a longitudinal slot running the length of the housing, having contained therein an air expandable singular tube running the full length of the longitudinal slot, said air expandable tube being sealed at one end, the opposite end being open to an air inlet port, said air inlet port being connected to a regulated air source by a supply tube, said air expandable tubing interfacing directly with the flexible blade along its entire length;

said applicator having means for being rotatably mounted on a coating machine.

3. The apparatus as claimed in claim 2, wherein the flexible blade is manufactured from spring steel.

4. The apparatus as claimed in claim 2, wherein the flexible blade is manufactured from plastic.

5. The apparatus as claimed in claim 4, wherein the plastic is cured polyurethane.

6. The apparatus as claimed in claim 3, wherein the blade holder and blade retainer are manufactured from aluminum.

7. The apparatus as claimed in claim 3, wherein the dams are manufactured from plastic.

8. The apparatus as claimed in claim 7, wherein the plastic is cured polyurethane.

9. A coating machine having at least one backing roll and including the apparatus as claimed in claim 1.

10. A coating machine having at least one backing roll and including the apparatus as claimed in claim 2.

* * * * *